US011220721B2

(12) United States Patent
Rösler et al.

(10) Patent No.: US 11,220,721 B2
(45) Date of Patent: Jan. 11, 2022

(54) HOT ROLLED FLAT STEEL PRODUCT CONSISTING OF A COMPLEX-PHASE STEEL WITH A LARGELY BAINITIC MICROSTRUCTURE AND METHOD FOR MANUFACTURING SUCH A FLAT STEEL PRODUCT

(71) Applicants: ThyssenKrupp Steel Europe AG, Duisburg (DE); thyssenkrupp AG, Essen (DE)

(72) Inventors: Thorsten Rösler, Muelheim an der Ruhr (DE); Liuyi Zhang, Ratingen (DE); Jörg Mertens, Duisburg (DE)

(73) Assignees: THYSSENKRUPP STEEL EUROPE AG, Duisburg (DE); THYSSENKRUPP AG, Essen (DE)

( * ) Notice: Subject to any disclaimer, the term of this patent is extended or adjusted under 35 U.S.C. 154(b) by 191 days.

(21) Appl. No.: 16/479,315

(22) PCT Filed: Jan. 16, 2018

(86) PCT No.: PCT/EP2018/050963
§ 371 (c)(1),
(2) Date: Jul. 19, 2019

(87) PCT Pub. No.: WO2018/134186
PCT Pub. Date: Jul. 26, 2018

(65) Prior Publication Data

US 2019/0338384 A1 Nov. 7, 2019

(30) Foreign Application Priority Data

Jan. 20, 2017 (WO) ..... PCT/EP2017/051141

(51) Int. Cl.

| | |
|---|---|
| ***B32B 15/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/42*** | (2006.01) |
| ***C22C 38/44*** | (2006.01) |
| ***C22C 38/58*** | (2006.01) |

(52) U.S. Cl.
CPC ..... *C21D 8/0226* (2013.01); *C21D 8/0263* (2013.01); *C21D 9/46* (2013.01); *C22C 38/001* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/42* (2013.01); *C22C 38/44* (2013.01); *C22C 38/58* (2013.01); *C21D 2211/001* (2013.01); *C21D 2211/002* (2013.01); *C21D 2211/003* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 2009/0050243 | A1 | 2/2009 | Satou et al. | |
| 2011/0297281 | A1 | 12/2011 | Satou et al. | |
| 2013/0061989 | A1* | 3/2013 | Nakamura | C22C 38/06 148/602 |
| 2015/0203946 | A1* | 7/2015 | Hammer | C21D 6/004 148/602 |
| 2017/0183753 | A1* | 6/2017 | Pipard | C22C 38/26 |
| 2019/0316222 | A1* | 10/2019 | Schulz | C21D 8/0247 |

FOREIGN PATENT DOCUMENTS

| | | | |
|---|---|---|---|
| CN | 101120113 | A | 2/2008 |
| CN | 101906567 | A | 12/2010 |
| CN | 105671447 | A | 6/2016 |
| CN | 108913991 | A | 11/2018 |

(Continued)

OTHER PUBLICATIONS

DIN EN 13925-1: Jul. 2003.

(Continued)

*Primary Examiner* — Seth Dumbris
(74) *Attorney, Agent, or Firm* — The Webb Law Firm

(57) ABSTRACT

A flat steel product and a method of making a flat steel product having a hole expansion of at least 60%, a yield strength of at least 660 MPa, a tensile strength of at least 760 MPa, and an elongation at break of at least 10%. The flat steel product is made from a complex-phase steel, which includes (in wt %) C: 0.01-0.1%, Si: 0.1-0.45%, Mn: 1-2.5%, Al: 0.005-0.05%, Cr: 0.5-1%, Mo: 0.05-0.15%, Nb: 0.01-0.1%, Ti: 0.05-0.2%, N: 0.001-0.009%, P: <0.02%, S: <0.005%, Cu: ≤0.1 %, Mg: ≤0.0005 %, O: <0.01 %, optionally one or more of Ni, B, V, Ca, Zr, Ta, W, REM, and Co, where Ni: ≤1%, B: ≤0.005%, V: ≤0.3%, Ca: 0.0005-0.005%, Zr, Ta, W: in total ≤2%, REM: 0.0005-0.05%, and Co: <1%, and iron and unavoidable impurities as the remainder, where % Ti>(48/14)% N+(48/32)% S and % Nb<(93/12)% C+(45/14)% N+(45/32)% S. The structure of the flat steel product includes (in area %) ≥80% bainite, <15% ferrite, <15% martensite, <5% cementite, and <5 vol % retained austenite.

15 Claims, No Drawings

(56) References Cited

FOREIGN PATENT DOCUMENTS

| | | | |
|---|---|---|---|
| EP | 1636392 | B1 | 3/2006 |
| EP | 2138599 | A1 | 12/2009 |
| EP | 2924140 | A1 | 9/2015 |
| EP | 3004401 | B1 | 4/2016 |
| JP | 2004232708 | A | 8/2004 |
| WO | 2016005780 | A1 | 1/2016 |

OTHER PUBLICATIONS

DIN EN 13925-2: Jul. 2003.
EN 13925-3: 2005 D.
DIN EN ISO 148-1: Jan. 2011.
DIN EN ISO 148-1 Bbl 1: Feb. 2014.
DIN EN ISO 148-2: May 2017.
DIN EN ISO 148-3: Apr. 2017.
DIN EN ISO 6892-1: Feb. 2017.
DIN EN ISO 6892-2: Sep. 2018.
ISO 16630: 2009(E).
Fengping, "Q&Aon Plate Production Knowledge", Metallurgical Industry Press, Feb. 2010, pp. 1-4. [Relevant for reasons discussed in the attached Office Action].
"Top-level Design of Green Steel Manufacturing Collaborative Innovation", Collaborative Innovation Center of Steel Technology, Northeastern University 2011, pp. 149-154, Metallurgical Industry Press, Oct. 2016. [Translation of relevant disclosure attached].

* cited by examiner

HOT ROLLED FLAT STEEL PRODUCT CONSISTING OF A COMPLEX-PHASE STEEL WITH A LARGELY BAINITIC MICROSTRUCTURE AND METHOD FOR MANUFACTURING SUCH A FLAT STEEL PRODUCT

CROSS-REFERENCE TO RELATED APPLICATIONS

This application is the United States national phase of International Application No. PCT/EP2018/050963 filed Jan. 16, 2018, and claims priority to International Application No. PCT/EP2017/051141 filed Jan. 20, 2017, the disclosures of which are hereby incorporated by reference in their entirety.

BACKGROUND OF THE INVENTION

Field of the Invention

The invention relates to a hot rolled flat steel product, which consists of a complex-phase steel with a largely bainitic microstructure and has superior mechanical properties, excellent welding suitability and good deformability which is demonstrated in an optimised hole expansion ability.

The invention further relates to a method for manufacturing a flat steel product according to the invention.

If information about the alloy contents of individual elements in the steel according to the invention is given in this text, this always relates to the weight (information in wt %), unless otherwise indicated. The information given on the proportions of the microstructure of a steel according to the invention relate, in contrast, in this text to the proportion, which the respective structural component has on a cut surface of a product produced from steel according to the invention (information in area %), unless otherwise indicated.

The flat steel products according to the invention are rolled products, such as steel strips, steel sheets or cut-outs and panels obtained therefrom, whose thickness is essentially lower than their width and length.

Description of Related Art

A hot rolled, high-strength steel sheet with a largely bainitic or ferritic structure is known from EP 1 636 392 B1 which should have a superior formabilityln the sense of this prior art, such steel sheets are considered high-strength if they have a tensile strength of at least 440 MPa. A correspondingly provided steel sheet should consist of, in addition to iron and unavoidable impurities, (in wt %) C: 0.01-0.2%, Si: 0.001-2.5%, Mn: 0.01-2.5%, P: up to 0.2%, S: up to 0.03%, Al: 0.01-2%, N: up to 0.01%, and O: up to 0.01%, wherein the steel can also optionally contain in total 0.001-0.8 wt % Nb, Ti or V and B: up to 0.01%, Mo: up to 1%, Cr: up to 1%, Cu: up to 2%, Ni: up to 1%, Sn: up to 0.2%, Co: up to 2%, Ca: 0.0005-0.005%, Rem: 0.001-0.05%, Mg: 0.0001-0.05%, Ta: 0.0001-0.05%.

Moreover, a hot rolled flat steel product is known from WO 2016/005780A1 which has a yield strength of more than 680 MPa and up to 840 MPa, a strength of 780-950 MPa, an elongation at break of more than 10% and a hole expansion of at least 45%. The flat steel product consists of a steel, which has (in wt %) 0.04-0.08% C, 1.2 1.9% Mn, 0.1-0.3% Si, 0.07-0.125% Ti, 0.05-0.35% Mo, 0.15%-0.6%, if the Mo content is 0.05-0.11%, or 0.10-0.6% Cr, if the Mo content is 0.11-0.35%, up to 0.045%, up to 0.005-0.1% Al, 0.002%-0.01% N, up to 0.004% S, up to 0.020% P and optionally 0.001-0.2% V, remainder being iron and unavoidable impurities. The microstructure of the flat steel product contains more than 70 area % of granular bainite and less than 20 area % of ferrite, with the remainder of the microstructure consisting of lower bainite, martensite and retained austenite and the total of the proportion of martensite and retained austenite being less than 5%. Aside from the requirement that the bainite contained in the microstructure is granular bainite, which differs from the so-called upper and lower bainite, no further information is given on the type and quality in which the bainite should be present in order to ensure an optimised property profile, in particular with respect to the hole expansion behaviour.

An increasing strength of steels is generally accompanied by a decreased formability, with the edge-crack sensitivity being a criterion for the deformability. Collared grooves, through-holes or relief holes are examples of edges moulded into flat steel products or components formed therefrom, in particular punched or cut edges, which are deformed further in a different manner and are loaded during practical use. If such edges are exposed to high loads during practical use of the respective flat steel product or component formed therefrom, breaks can emanate from the edges which ultimately lead to failure of the component.

A typical example of metal sheet components, in which the edge-crack sensitivity is particularly important, are bodywork or structural components of vehicles. Openings, recesses or the like are cut into these components often in order to fulfil the respective function intended for the component or the lightweight structure requirements. While driving, the components are exposed to highly dynamically changing loads, which occur for example at a vehicle which drives on a poor road and thereby is exposed to massive impact loads. Practical studies show that, time and again, damage results from breaks, which emanate from a cut edge of the component.

Since the complexity of the shape of constructions made from steels of the type in question here increases and increasingly greater requirements are placed on the strength of the steels, there is a need for steel materials, which not only have maximised strengths, but also a low tendency for edge-crack. The hole expansion ability determined according to ISO 16630:2009 is normally used as a measure for tendency for edge-crack. The examination conditions are selected within the wide ranges permitted according to the standard for realistic modelling so that they reflect the highest demands on the hole expansion ability.

SUMMARY OF THE INVENTION

Against the background of the prior art, the object was to develop a flat steel product, which has a minimised edge-crack sensitivity over a wide temperature range and consists of a steel, which is composed of alloy elements that are as cost-effective as possible and demonstrates good suitability for welding with conventional welding methods.

A method for manufacturing such a flat steel product is also disclosed herein.

A hot rolled flat steel product according to the invention is accordingly made from a complex-phase steel, in technical jargon also called "CP steel" and has, in the state according to the invention, a hole expansion determined according to ISO 16630:2009 of at least 60%, in each case determined according to DIN EN ISO 6892-1:2014, a yield strength Rp0.2 of at least 660 MPa, a tensile strength Rm of at least 760 MPa and an elongation at break A80 of at least 10%.

DESCRIPTION OF THE INVENTION

The complex-phase steel of a hot rolled flat steel product according to the invention consists, according to the invention, of (in wt %)

C: 0.01-0.1%,
Si: 0.1-0.45%,
Mn: 1-2.5%,
Al: 0.005-0.05%,
Cr: 0.5-1%,
Mo: 0.05-0.15%,
Nb: 0.01-0.1%,
Ti: 0.05 0.2%,
N: 0.001-0.009%,
P: less than 0.02%,
S: less than 0.005%,
Cu: up to 0.1%
Mg: up to 0.0005%,
O: up to 0.01%,
in each case optionally of one element or a plurality of elements from the group "Ni, B, V, Ca, Zr, Ta, W, REM, Co" with the following stipulation
Ni: up to 1%,
B: up to 0.005%,
V: up to 0.3%,
Ca: 0.0005-0.005%,
Zr, Ta, W: in total up to 2%,
REM: 0.0005-0.05%,
Co: up to 1%,
and of iron and manufacture-related unavoidable impurities as the remainder, wherein the contents of the complex-phase steel of Ti, Nb, N, C and S meet the following conditions:

$$\% \text{ Ti} > (48/14)\% \text{ N} + (48/32)\% \text{ S} \quad (1)$$

$$\% \text{ Nb} < (93/12)\% \text{ C} + (45/14)\% \text{ N} + (45/32)\% \text{ S} \quad (2)$$

wherein % Ti: respective Ti content,
% Nb: respective Nb content,
% N: respective N content,
% C: respective C content,
% S: respective S content, wherein % S can also be "0".

The microstructure of a hot rolled flat steel product according to the invention consists of at least 80 area % bainite, of less than 15 area % ferrite, of less than 15 area % martensite, of less than 5 area % cementite and of less than 5 vol % retained austenite. The remainder of the microstructure can of course be occupied by such phases not mentioned here, but which are technically unavoidably present and which are present in such low proportions that they have no effect on the properties of the flat steel product provided according to the invention.

As mentioned above, the components of the microstructure of a flat steel product according to the invention indicated in area % are determined in a manner known per se by light microscope. For this purpose, cross-section polishes are considered. In practice, the process can then be carried out for example as follows to determine the area percentages of the respective structural phases "bainite", "ferrite", "martensite" and "cementite":

The cross-section polishes are removed in each case at the start and end of the flat steel product in relation to the hot rolling direction at five positions distributed over the width of the flat steel product and namely from an edge region, which is 10 cm away from the left edge of the flat steel product, from a region of the flat steel product, which is arranged at a distance to the left edge, which corresponds to a quarter of the width of the flat steel product, from a region of the middle (half the width) of the flat steel product, from a region of the flat steel product, which is arranged at a distance to the right edge of the flat steel product, which corresponds to a quarter of the width of the flat steel product and from an edge region, which is arranged roughly 10 cm away from the right edge of the flat steel product. The polishes are examined over the strip thickness in core layer, at ⅓ sheet metal thickness and at both surfaces. The polishes are polished for the light microscopic examination and etched with 1% HNO3 acid. Three images with 1000-times magnification are taken in each layer. The evaluated image detail is for example 46 μm×34.5 μm. The results of all image details determined for the samples are averaged arithmetically.

The proportion of retained austenite indicated in vol % is determined by means of x-ray diffraction (XRD) according to DIN EN 13925.

A flat steel product according to the invention is characterised by a hole expansion of at least 60%, with hole expansions of at least 80% often being achieved. The hole expansions of flat steel products according to the invention are determined as part of the approach predefined by ISO 16630:2009 taking into account the following information: A test stamp with a diameter of 50 mm is used. The test stamp top angle is 60°. The test matrix inner diameter is 40 mm. The test matrix radius is 5 mm. The hold-down device diameter is 55 mm. The punching of the holes takes place at a punching speed of 4 mm/s without additional lubricant. The hold-down device force when punching the holes is 50+/−5 MPa. The hold-down device pressure applied during the hole expansion test between the hold-down device and test matrix is also 50+/−5 MPa without additional lubricant. The test temperature is 20° C. The stamp speed is 1 mm/s. Samples of a hot rolled steel strip are examined. The samples originate in each case from the start of the strip and from the end of the strip. They are removed from the left and right edge region of the steel strip, from a region, which is arranged at a distance corresponding to a quarter of the strip width, from the left edge of the steel strip, from a region, which is arranged at a distance corresponding to a quarter of the strip width, from the right edge of the steel strip and from the region of the strip middle. For each test, two samples are tested per position (left edge, left quarter of the strip width, strip middle, right quarter of the strip width, right edge region). The results of all samples of a strip are averaged arithmetically.

A flat steel product composed according to the invention also has a yield strength Rp0.2 of at least 660 MPa, typically 660-830 MPa, a tensile strength Rm of at least 760 MPa and an elongation at break A80 of at least 10% (in each case determined according to DIN EN ISO 6893-1:2014), without showing a notable yield point.

The steel of a flat steel product according to the invention has according to DIN EN ISO 148 in the current version determined high notch-bar impact values corresponding to a notch-bar impact strength-temperature curve of type II of at least 27J with test temperatures of up to −80° C. such that its ductility and edge-crack sensitivity characterised by the high hole expansion values are also maintained at low temperatures.

The microstructure of a flat steel product according to the invention consists at least 80 area % of bainite, with a completely bainitic structure in a technical sense proving to be particularly advantageous with respect to the desired property combination of a steel according to the invention. Accordingly, the proportions of other structural components, in particular also the proportions of ferrite and martensite, are optimally as low as possible.

Furthermore, a pronounced yield strength would develop with increasing ferrite content. For this reason, the invention envisages that the proportion of ferrite in the microstructure of the flat steel product according to the invention is to be kept low, it should be, in any case, below 15 area %, in particular below 10 area % or optimally, below 5 area %.

In the same manner, the proportion of martensite in the microstructure of a flat steel product according to the invention is less than 15 area %, in particular less than 10 area % or it is optimally below 5 area %.

The invention assumes that a particular significance is attributed to the total proportion of bainite in the microstructure of the flat steel product according to the invention and the quality of the bainite with respect to the desired optimised adjustment of the mechanical properties, in particular the high hole expansion values, which a flat steel product according to the invention achieves.

The microstructural composition of bainite is very complex. It can be said in simplified terms that bainite is a non-laminar structural mix of dislocation-rich ferrite and carbides. Additionally, further phases such as retained austenite, martensite or perlite can exist. The bainitic transformation starts at nucleation sites in the microstructure, e.g. the austenitic grain boundaries. Ferritic plates, so-called "sub units" grow from the starting point into the austenite, which consist of dislocation-rich ferritic bainite with maximum 0.03 wt % of dissolved C. They continue to build up virtually parallel to one another in the orientation of the austenitic grain and thus form so-called "sheaves", i.e. "bundles" or "packets". The sub units are only separated from one another by low-angle grain boundaries, on which carbides may also be present, but do not include any carbides themselves. In contrast, the sheaves continue to grow inside the austenitic grain until they meet an obstacle or one another. Therefore, there are numerous sheaves inside a former austenitic grain which have many high-angle grain boundaries with an angle >45° to one another. A largest possible number of high-angle grain boundaries between the sheaves is advantageous to achieve a good edge-crack resistance since they serve as obstacles to the development and spreading of microcracks.

In the case of isothermic transformation in the laboratory, the sheaves mainly form a notably elongated shape. In contrast, during the continuous cooling in the coil, which is relevant in practice, a so-called "granular" bainite, develops. At this type of bainite shape, the sheaves are plate-shaped.

Due to these structural particularities, the definition of a "fine structure" for bainitic structures of the type according to the invention is particularly difficult. There is no standard for this. One possibility of determining the fineness of a bainitic structure could be measuring the thickness of the former "pancaked" austenitic grains, which can be determined by means of EBSD ("EBSD"=Electron BackScatter Diffraction). Generally, it can be assumed that the number of sheaves increases with decreasing austenitic grain boundary, i.e. the sheaves are smaller and therefore the structure is finer.

A pronounced yield strength with so-called Lüders elongation is lacking in the case of a flat steel product according to the invention due to its bainitic structures. Due to the low mean free path of the dislocations of roughly double the sheave width of the largely bainitic structure of a flat steel product according to the invention, no interaction in the form of a dislocation front can be built up, at which the dislocations and the foreign atoms are mutually dynamically influenced by the formation of so-called "cottrell clouds" and would lead to the mentioned Lüders elongation.

Due to the lack of a pronounced yield strength, an optimal behaviour of the flat steel product according to the invention is ensured during transformation, such as for example in the case of forming tubes or passages. The influences of the alloy components of a complex-phase steel composed according to the invention are explained in detail below. In the case of alloy elements, for whose content only one upper limit is indicated in each case, the content of the alloy element in question can in each case also be equal to "0", i.e. for example in the range of the detection limit or therebelow or at least so low that the alloy element, in the technical sense, has no effect in relation to the property spectrum of the steel according to the invention.

In the complex-phase steel according to the invention, contents of carbon "C" of 0.01-0.1 wt % ensure that bainite contents of at least 80 area % are present in the microstructure of the steel according to the invention. At the same time, these C contents ensure sufficient strength of the bainite. At least 0.01 wt % of C is required in order to form carbides and carbonitrides during the thermomechanical rolling in the presence of suitable carbide and carbonitride formers. Similarly, the formation of proeutectoid ferrite during the course of the thermomechanical rolling can be avoided with C contents of at least 0.01 wt % in the steel according to the invention. The positive effects of the presence of C in the steel according to the invention can be used particularly reliably if the C content is at least 0.04 wt %. Contents of more than 0.1 wt % C would, however, lead to a drastic decrease in ductility and therefore to a poorer processability of the steel. Too high C contents would also entail undesirably high proportions of ferrite in the microstructure and further undesired large proportions of retained austenite and in addition favour the formation of undesirably coarse carbides. Therefore, the resistance to edge-crack would also be reduced. Moreover, the welding suitability would decrease with higher C contents. Possible negative influences of the C contents provided according to the invention can, therefore, be particularly effectively prevented due to a C content of the complex-phase steel according to the invention limited to not more than 0.06 wt %

Silicon "Si" is contained in contents of 0.1-0.45 wt % in the complex-phase steel according to the invention in order to delay the carbide formation. Finer carbides are achieved due to the shift of the precipitation at lower temperature achieved as a result of the presence of Si in the complex-phase steel according to the invention. This contributes to optimising the deformability of the steel according to the invention. Si in the contents provided according to the invention also contributes to the increase of the strength due to solid solution hardening. To this end, Si contents of at least 0.1 wt %, optimally at least 0.2 wt % are required. In the case of contents of Si above 0.45 wt %, there would be the danger of segregation near the surface. These segregations would cause not only surface errors and reduce the welding suitability, but rather also worsen the suitability of products made from steel according to the invention, in particular flat steel products, such as metal sheets or strips, for coating with a metallic protective layer, in particular a Zn-based protective layer, for example by hot dip coating or electrolytic coating. In order to particularly reliably avoid negative effects of the presence of Si in the steel according to the invention, the Si content can be limited to at most 0.3 wt %.

Manganese "Mn" is contained in the complex-phase steel according to the invention in contents of 1-2.5 wt %. Mn causes a strong solid solution hardening, delays, as an austenite former, the kinetics of transformation from austenite to ferrite and therefore contributes to the lowering of the bainite start temperature. A low bainite start temperature favourably affects the thermodynamic rolling. By forming MnS, Mn also contributes to the binding of contents of sulphur present as a technically unavoidable impurity, if, to this end, there are no sufficient quantities of other elements, such as Ti, provided for binding S according to the invention, in the respective steel alloy composed according to the invention. Hot cracking can be avoided due to the binding of S. These positive effects of Mn can be used in the steel composed according to the invention in particular if the Mn content is at least 1.7 wt %. Excessively high Mn contents would, however, entail the danger of segregations developing, which could result in inhomogeneities while distributing the properties of the steel material according to the invention. The production and deformation of the steel according to the invention would also be more difficult in the case of excessively high Mn contents. These negative effects can also be particularly reliably avoided since the Mn content of the steel according to the invention is limited to at most 1.9 wt %.

Aluminium "Al" in contents of 0.005-0.05 wt % is used for the production of the steel according to the invention for deoxidation. To this end, Al contents of at least 0.02 wt % may be advantageous. However, excessively high Al contents would reduce the castability of the steel.

Chromium "Cr", on the one hand, delays the proeutectoid ferrite formation (phase transformation delay) in dissolved form at higher temperatures. Furthermore, Cr is added in the alloy concept according to the invention in particular in order to reduce the C diffusion in the retained austenite during the bainitic transformation. Cr only forms carbides in the case of comparably low temperatures, namely in the temperature range of the bainitic transformation. Dissolved carbon remaining in the crystal lattice, which would normally diffuse from the transformed structural regions into the austenitic regions, is largely bonded by Cr, as soon as carbon contents >0.03% C result locally (e.g. $(Cr, Fe)_4C$, $(Cr, Fe)_7C3$). As a result, the austenite cannot be stabilised by C enrichment. Larger proportions of retained austenite in the structure of the steel according to the invention are thus avoided. A further positive effect is that the martensite start temperature (Ms temperature) drops. The probability of the retained austenite transforming martensitically instead of bainitically in the further cooling process hereby drops. Therefore, phases with significant hardness differences are largely avoided and the edge-crack sensitivity is reduced. In order to achieve these effects, the steel of a flat steel product according to the invention contains Cr in content of 0.5-1 wt %. The positive effects of Cr can be particularly reliably used since the Cr content of the steel according to the invention is at least 0.6 wt %, in particular at least 0.65 wt %. Cr contents of at least 0.69 wt % have been found to be particularly advantageous here. Cr contents of up to 0.8 wt % have a particularly effective impact.

Molybdenum "Mo" in contents of 0.05-0.15 wt % leads to the formation of fine carbides or carbonitrides in the steel according to the invention. They delay the recrystallisation of the austenite in the hot rolling process and contribute, as explained further below in detail, to the structural refinement by increasing the non-recrystallisation temperature Tnr. A strength increase is achieved due to the fine structure and the fine carbides. This effect is also increased by the simultaneous presence of Nb provided according to the invention in the steel according to the invention. Mo also delays all phase transformation processes. This delay can lead to a spatial separation of the ferrite/bainite phase fields in the TTT diagram. At the same time, Mo reduces the bainite start temperature, i.e. the temperature from which the bainite formation begins. Mo also suppresses the grain boundary segregation of further elements (e.g. phosphorus). In order to also utilise these effects in the case of the steel according to the invention, the Mo content is at least 0.05 wt %, in particular at least 0.1 wt %. In the prior art, the positive effects of Mo are utilised to set the high mechanical properties required in each case, such as an optimised hole expansion ability. Due to the high costs, which are associated with high Mo contents, the Mo content of a steel according to the invention is, however, limited to at most 0.15 wt % from cost-benefit viewpoints. At the same time, the C, Nb and Cr contents of the steel according to the invention are set such that in spite of the comparably low Mo contents provided according to the invention, mechanical properties, in particular a high hole expansion ability, are achieved, the properties of alloy concepts known from the prior art and based on high Mo contents are at least the same.

Niobium "Nb" has comparable effects to Mo in the steel according to the invention. Nb is one of the most effective elements for a recrystallisation delay at high temperatures by forming fine precipitates. By adding Nb, the conditions for recrystallisation and thermomechanical rolling are positively influenced. In order to achieve these effects, a content of at least 0.01 wt % Nb is required, with contents of at least 0.045 wt % having been proven to be particularly advantageous. Nb contents of more than 0.1 wt % should, in contrast, be avoided because Nb contents above this limit would lead to the formation of coarser carbides and to the reduction of the welding suitability. The effect of Nb in the steel according to the invention can be particularly effectively used if the Nb content is limited to max. 0.06 wt %. Practical tests have shown here that in the case of Nb contents of 0.045-0.06 wt % and in the case of simultaneous presence of 0.03-0.09 wt % C in the structure of the steel according to the invention, very fine Nb carbide and Nb carbonitride particles can be achieved with an average diameter of 4-5 nm.

Titanium "Ti" also forms fine carbides or carbonitrides, which cause a strong strength increase. For this purpose, steel according to the invention contains 0.05-0.2 wt % Ti, with the positive influence of Ti in the case of Ti contents of at least 0.1 wt % being particularly reliable to use. In the case of contents of more than 0.2 wt %, the effect of the particle hardening is, in contrast, largely saturated. Optimal effectiveness in this respect can be achieved since the Ti content is limited to not more than 0.13 wt %.

The Ti content and the N content of a steel according to the invention is correlative. At high temperatures, TiN is initially formed, whose presence can also contribute to the improvement of the mechanical properties. TiN initially formed suppresses the grain growth during the reheating of the slabs since the particles are not dissolved.

The good welding suitability of the steel according to the invention for all conventional welding processes has been proven by an optimal carbon equivalent in this respect which is low irrespective of which method known in the prior art is used to calculate it. One of the most common methods to calculate the carbon equivalent is specified in the steel iron materials sheet SEW 088 Supplementary Sheet 1:1993-10. The carbon equivalent CET determined here for flat steel products according to the invention is often at values of at most 0.45%, preferably at values of at most 0.30%.

The mechanical characteristics values for the welding of a flat steel product according to the invention in the weld seam region and the heat affected zone remain at a similar level as the base material due to the titanium nitrides contained in the flat steel product according to the invention as a result of the presence of Ti and N, which already form in the melt when the steel is produced and do not dissolve in the welding process. The titanium nitrides effectively counteract a notable grain coarsening and simultaneously act as nuclei for the crystal reformation inside the melt.

The size of initially formed TiN particles is in particular dependent on the Ti:N ratio. The greater the value of the Ti/N ratio, the more finely distributed TiN particles will precipitate from a temperature of roughly 1300° C. during steel solidification since all N atoms can quickly form a bond with Ti atoms. Due to the fine distribution and low initial size of the TiN precipitates, excessive growth of the particles is prevented, which could otherwise occur as a result of Ostwald ripening between 1300-1100° C. during slab cooling and furnace campaign. To support this effect, the ratio % Ti/% N formed by the Ti content % Ti and the N content % N can be set to % Ti/% N<3.42.

Nitrogen "N" is contained in the steel according to the invention in contents of 0.001-0.009 wt % in order to enable the formation of nitrides and carbonitrides. This effect can be achieved particularly reliably with N contents of at least 0.003 wt %. At the same time, the N content of the steel according to the invention with max. 0.009 wt % is limited such that coarse Ti nitrides are largely avoided. In order to achieve this particularly reliably, the N content can be limited to max. 0.006 wt %.

Sulphur "S" and phosphorus "P" belong to the in general undesired impurity components of a steel according to the invention, but technically unavoidably enter the steel in the course of the melting. However, for a low edge-crack sensitivity in the case of a bainitic concept, it is important to set, in particular the S content, as low as possible. S forms the ductile bond MnS with Mn. This phase extends during hot rolling in the rolling direction and affects significantly negatively the edge-crack sensitivity due to low strength in comparison to other phases. Therefore, the sulphur content should be set as low as possible in the secondary metallurgical process. The contents of Ti provided according to the invention can in this respect also be used to bind S since Ti forms titanium sulphide (TiS) with S or together with C forms titanium carbosulphide ($Ti_4C_2S_2$). These sulphides have a notably higher hardness than MnS and hardly extend during hot rolling such that there are no harmful MnS lines after rolling. In order to avoid negative effects on the properties of the steel according to the invention, its S content is therefore limited to at most 0.005 wt %, in particular at most 0.001 wt % and its P content to at most 0.02 wt %.

With condition (1)

$$\% \text{ Ti} > (48/14)\% \text{ N} + (48/32)\% \text{ S}$$

the Ti content % Ti, the N content % N and the S content % S of a steel according to the invention are set in relation to one another such that a sufficient formation of nucleation sites for the bainitic transformation by TiN and an optimised fine granularity is ensured after welding.

At the same time, the Nb content % Nb, the C content % C, N content % N and the S content % S of a steel according to the invention are matched to one another such that an optimised fine granularity is achieved by the formation of a sufficient number of nucleation sites and an optimised strength by the formation of Nb(C, N) taking into account the previously occurring bonding of N by Ti. This can be expressed by the relationship $$\% \text{ Nb} < (93/12)\% \text{ C} + [(93/14)\% \text{ N} - (48/14)\% \text{ N}] + (45/32)\% \text{ S}$$

which in turn gives the condition (2)

$$\% \text{ Nb} < (93/12)\% \text{ C} + (45/14)\% \text{ N} + (45/32)\% \text{ S}$$

Copper "Cu" also enters into the steel according to the invention in the course of the steel production, as a generally unavoidable by-element. The presence of higher contents of Cu would contribute only to a small extent to the increase in strength and would also have negative effects on the deformability of the steel. In order to prevent the therefore largely negative influences of Cu, the Cu content is limited in the steel according to the invention to at most 0.1 wt %, in particular at most 0.06 wt %.

Magnesium "Mg" in the steel according to the invention also represents a by-element unavoidably entering the steel in the course of the steel production. Mg can be used to deoxidise when producing a steel according to the invention. In this case, Mg forms, with 0 and S, fine oxides or sulphides, which can act favourably on the ductility of the steel during welding in the region of the heat affected zone surrounding the respective welding point by reducing the grain growth. However, in the case of higher Mg contents, the danger of adding the dip tube due to premature local clogging increases when casting the steel in continuous casting. In order to prevent this danger, the Mg content of a steel according to the invention is limited to max. 0.0005 wt %.

The content of oxygen "O" of a steel according to the invention is limited to max. 0.01 wt % in order to prevent the development of coarse oxides which would entail the danger of embrittling the steel.

One or a plurality of elements from the group "Ni, B, V, Ca, Zr, Ta, W, REM, Co" can optionally be added to the steel according to the invention in order to achieve certain effects. In this case, the following stipulations apply to the contents of the respectively optionally present alloy elements of this group:

Nickel "Ni" may be present in contents of up to 1 wt %. Ni increases the strength of the steel here. At the same time, Ni contributes to improving the low temperature ductility (e.g. notched bar impact testing according to Charpy DIN EN ISO 148:2011). Moreover, the presence of Ni improves the ductility in the heat affected zone of weld seams. However, the basic ductility of the steel according to the invention achieved due to its predominantly bainitic structure is sufficient for most applications. Therefore, Ni is only added as required if a further increase in this property is sought. From a costs/benefits point of view, Ni contents of max. 0.3 wt % have proven particularly expedient in this context.

Boron "B" can be added optionally to the steel according to the invention in order to delay the bainitic transformation and to support the development of acicular structures in the microstructure of the steel according to the invention. B causes this strengthening of the transformation delays (ferrite/bainite and bainite/martensite) in particular in combination with Nb or V. In the case of simultaneous presence of V and B, the steel according to the invention has, in the time-temperature transformation diagram (TTT diagram), a very well pronounced bainite field, which can be achieved in the case of cooling the steel with comparably low and a wide range of cooling speeds of for example 5-50° C./s. In the case of combined presence of B and Nb, however, a significant increase in the size of Nb(CN) precipitates can occur and as a result of this an increase of packet size and needle length of the bainite. Negative impacts of the presence of B, as also the danger of grain boundary segregation, can be avoided since the B content is limited to max. 0.005 wt %, in particular 0.003 wt %, with the positive effects of the presence of B being able to be reliably used in the case of contents of at least 0.0015 wt %.

Vanadium "V" can also be optionally added to a steel according to the invention in order to obtain fine V carbides or V carbonitrides in the structure of the steel and, as explained above, in combination with B in order to support the formation of a notably exposed bainite field in the TTT diagram. These positive effects can be reliably used if at least 0.06 wt % V is contained in the steel. Negative impacts of the presence of V, such as the formation of coarse clusters arising from V in combination with Nb particles, are prevented since the V content in the steel alloyed according to the invention is limited to at most 0.3 wt %, in particular at most 0.15 wt %.

As a further option, calcium "Ca" can be specifically present in the steel according to the invention in contents of 0.0005-0.005 wt % in order to cause shaping of non-metallic inclusions (predominantly sulphides, e.g. MnS), which, if present, could increase the edge-crack sensitivity. At the same time, Ca is an inexpensive element for deoxidising, if particularly low oxygen contents are supposed to be set in order to reliably prevent, for example, the development of harmful Al oxides in the steel according to the invention. Furthermore, Ca can contribute to the binding of S present in the steel. Ca forms, together with Al, ball-shaped calcium aluminium oxides and binds sulphur to the surface of the calcium aluminium oxides.

Zirconium "Zr", tantalum "Ta" or tungsten "W" can optionally also be added to the steel according to the invention in order to support the development of a fine-grained structure by formation of carbides or carbonitrides. To this end, from a costs/benefits point of view and with respect to possible negative effects of the presence of excessively large contents, like an impairment of the cold formability of the steel according to the invention, the contents of Zr, Ta or W contents in a steel according to the invention are also set such that the total of the contents of Zr, Ta and W is at most 2 wt %.

Rare earth metals "REM" can be added to the steel according to the invention in contents of 0.0005-0.05 wt % in order to shape non-metallic inclusions (largely sulphides e.g. MnS) and cause deoxidation of the steel when it is produced. At the same time, REM can contribute to grain fineness. Contents of REM above 0.05 wt % should be avoided since such high contents involve the danger of clogging and could therefore impair the castability of the steel.

As a further optionally added element, cobalt "Co" may be present in the steel according to the invention in order to support the development of a fine structure in the steel according to the invention by inhibiting the grain growth. This effect is achieved in the case of Co contents of up to 1 wt %.

While designing the steel, of which a flat steel product according to the invention consists, the invention is therefore based on the idea that only low contents of molybdenum should be used, but that a complete substitution of Mo is not expedient. Therefore, a steel according to the invention contains a mandatory element of 0.05-0.1 wt % Mo. At the same time, contents of Cr and Nb are present in the steel according to the invention in the case of a very low carbon content in order to substitute the advantageous effect known from the prior art with higher Mo contents. An optimised precipitation behaviour is achieved by the combination of C, Mo, Cr and Nb according to the invention.

An essential means for this is the setting of the contents of the elements Ti, Nb, Cr, Mo, C, N carried out according to the invention in the steel of a flat steel product according to the invention. The carbon offering is set so low that the precipitation of the finest possible particles is favoured, but at the same time so high that it leads to the formation of a sufficiently high number of precipitates. In this case, the interaction of C with Mo, Nb and Cr is decisive. Mo and Nb have similar carbide formation temperatures and mutually strengthen their effect in relation to carbide formation. Due to the carbide formers provided according to the invention, the carbides are finer, as a result they delay the recrystallisation of the austenite even more strongly during thermo-mechanical rolling and as a result contribute particularly strongly to the structural fineness of the bainite obtained in the flat steel product.

By a suitable combination of the contents of the alloy elements C, Si, Mn, Ni, Cr and Mo, the hardness in the structure of a flat steel product can be specifically influenced whilst simultaneously taking into account the cooling rates decisive for setting the hardness. In order to achieve high hole expansions, it is the central aim to set the hardnesses of the phase proportions such that they do not deviate too greatly from one another. Both the solid solution hardening and the formation of precipitates are significant.

As previously mentioned above, the quality of the bainite with respect to the optimisation, achieved according to the invention, of the mechanical properties of the flat steel product according to the invention is particularly significant. The superior hole expansion ability of flat steel products according to the invention is in particular achieved by suitably matching the hardness of the bainite contained in the structure of a flat steel product according to the invention in relation to the total hardness.

A particularly homogeneous hardness distribution in the structure of a flat steel product according to the invention and an associated hole expansion ability also satisfying the highest requirements can therefore be ensured since the alloy contents of the steel of a flat steel product according to the invention are matched to one another such that for the theoretical hardness HvB of the bainite contained in the microstructure of the flat steel product, calculated according to the formula $$HvB=-323+185\%\ C+330\%\ Si+153\%\ Mn+65\%\ Ni+144\%\ Cr+191\%\ Mo+(89+53\%\ C-55\%\ S-22\%\ Mn-10\%\ Ni-20\%\ Cr-33\%\ Mo)*\ln dT/dt \quad (3)$$

and the theoretical total hardness Hv of the flat steel product, calculated according to the formula $$Hv=XM*HvM+XB*HvB+XF*HvF \quad (4)$$

the following applies:

$$|(Hv-HvB)/Hv|\leq 5\%$$

with the theoretical hardness HvM of the martensite possibly contained in the structure of the flat steel product being calculated according to the formula $$HvM=127+949\%\ C+27\%\ Si+11\%\ Mn+8\%\ Ni+16\%\ Cr+21*\ln dT/dt, \quad (5)$$

and with the theoretical hardness HvF of the ferrite HvF possibly contained in the structure of the flat steel product being calculated according to the formula $$HvF=42+223\%\ C+53\%\ Si+30\%\ Mn+12.6\%\ Ni+7\ Cr+19\%\ Mo\pm(10-19\%\ Si+4\%\ Ni+8\%\ Cr-130\%\ V)*\ln dT/dt \quad (6)$$

with "% C" designating the respective C content, "% Si" the respective Si content, "% Mn" the respective Mn content, "% Ni" the respective Ni content, "% Cr" the respective Cr content, "% Mo" the respective Mo content and "% V" the respective V content of the complex-phase steel, in each case indicated in wt %, "ln dT/dt" the natural logarithm of the so-called "t 8/5 cooling rate", i.e. the cooling rate, at which the temperature range of 800-500° C. is passed through during cooling, indicated in Kis, "XM" the proportion of the martensite, "XB" the proportion of the bainite and "XF" the proportion of the ferrite in the structure of the flat steel product, in each case indicated in area %.

The ratio (Hv−HvB)/Hv describes the hardness difference between the theoretical total hardness and the bainite hardness as the dominating phase and as such represents an indication of the homogeneity of the hardness distribution in the structure of a flat steel product according to the invention. Since the calculated theoretical total hardness Hv deviates in terms of the amount by at most 5% from the calculated theoretical hardness HvB of the structure of a flat steel product according to the invention, it is ensured that a uniform hardness distribution is present in the structure. In this way it is avoided that phases of different hardness can act as inner notches which can initiate failure in hole expansion. The closer the hardness Hv of the total structure to the hardness HvB of the bainitic phase dominating in the structure of a flat steel product according to the invention, i.e. the smaller the deviation between the hardness Hv and the hardness HvB, the better a flat steel product according to the invention behaves during the hole expansion.

It can serve the same purpose if in the case of the presence of ferrite in the microstructure of the flat steel product for the theoretical hardness HvB of the bainite contained in the microstructure of the flat steel product, calculated according to the previous already mentioned formula $$HvB=-323+185\%\ C+330\%\ Si+153\%\ Mn+65\%\ Ni+144\%\ Cr+191\%\ Mo+(89+53\%\ C-55\%\ Si-22\%\ Mn-10\%\ Ni-20\%\ Cr-33\%\ Mo)*\ln dT/dt \quad (3)$$

and the theoretical hardness HvF of the ferrite contained in the microstructure of the flat steel product, calculated according to the formula $$HvF=42+223\%\ C+53\%\ Si+30\%\ Mn+12.6\%\ Ni+7\%\ Cr+19\%\ Mo+(10-19\%\ Si+4\%\ Ni+8\%\ Cr-130\%\ V)*\ln dT/dt \quad (6)$$

the following applies:

$$|(HvB-HvF)/HvF|\leq 35\%$$

with "% C" here designating the respective C content, "% Si" the respective Si content, "% Mn" the respective Mn content, "% Ni" the respective Ni content, "% Cr" the respective Cr content, "% Mo" the respective Mo content and "% V" the respective V content of the complex-phase steel, in each case indicated in wt % and "ln dT/dt" the natural logarithm of the so-called "t 8/5 cooling rate" in K/s.

The ratio (HvB−HvF)/HvF describes the difference between the theoretical hardness HvB of the bainite phase dominating the structure of a flat steel product according to the invention and the theoretical hardness HvF of the ferrite phase also possibly present in the structure, which, as a softer phase, can have a significant influence on potential microcracks in the phase boundaries. By matching the alloy components of the steel according to the invention to one another such that the theoretical hardness HvB, calculated according to formula (3), of the bainite contained in the structure of the flat steel product deviates in terms of the amount by at most 35% from the theoretical hardness, calculated according to formula (6), of the ferrite possibly contained in the structure of the steel, the risk can be minimised such that microcracks originate from phases contained in the structure, between which there are higher strength differences.

By restricting the deviation of the theoretical hardnesses HvB and HvF in the manner according to the invention by suitably matching the contents of the alloy components, a property distribution also optimised with respect to the hole expansion behaviour can be ensured in the flat steel product according to the invention.

According to the invention, a flat steel product provided according to the invention can be manufactured by completing at least the following work steps according to the invention:

a) Melting a steel, comprising (in w) C: 0.01-0.1%, Si: 0.1-0.45%, Mn: 1-2.5%, Al: 0.005-0.05%, Cr: 0.5-1%, Mo: 0.05-0.15%, Nb: 0.01-0.1%, Ti: 0.05-0.2%, N: 0.001-0.009%, P: less than 0.02%, S: less than 0.005%, Cu: up to 0.1%, Mg: up to 0.0005%, 0: up to 0.01% and in each case optionally of one element or a plurality of elements from the group "Ni, B, V, Ca, Zr, Ta, W, REM, Co" and iron and unavoidable impurities as the remainder, wherein it applies for the contents of the optionally added elements of the group "Ni, B, V, Ca, Zr, Ta, W, REM" that the Ni content is up to 1%, the B content is up to 0.005%, the V content is up to 0.3%, the Ca content is up to 0.0005-0.005%, the content of Zr, Ta and W is in total up to 2%, the contents of REM are 0.0005-0.05% and the content of Co is up to 1%, and wherein the contents of the complex-phase steel of Ti, Nb, N, C and S meet the following conditions:

$$\%\ Ti>(48/14)\%\ N+(48/32)\%\ S \quad (1)$$

$$\%\ Nb<(93/12)\%\ C+(45/14)\%\ N+(45/32)\%\ S \quad (2)$$

wherein % Ti: respective Ti content,
% Nb: respective Nb content,
% N: respective N content,
% C: respective C content,
% S: respective S content, wherein % S can also be "0";

b) Casting the melt to form an intermediate product;

c) Heating the intermediate product to a pre-heating temperature of 1100-1300° C.;

d) Hot rolling the intermediate product to form a hot rolled strip, wherein the rolling start temperature WAT of the intermediate product at the start of the hot rolling is 1000-1250° C. and the rolling final temperature WET of the finished hot rolled strip is 800-950° C. and wherein the hot rolling is carried out in a temperature range RLT-RST with a reduction ratio d0/d1 of at least 1.5, wherein the starting thickness d0 of the hot rolled strip prior to the beginning of the rolling is in the temperature range RLT-RST is designated with d0 and the thickness of the hot rolled strip after rolling in the temperature range RLT RST is designated with d1 and wherein in the event hat the reduction ratio d0/d1 is ≤2, the temperature is RLT=Tnr+50° C., in the event that the reduction ratio d0/d1 is >2, the temperature is RLT=Tnr+100° C., in the event that the reduction ratio d0/d1 is ≥2. the temperature is RST=Tnr−50° C., in the event that the reduction ratio d0/d1 is <2, the temperature is RST=Tnr−100° C., and the non-recrystallisation temperature is designated with Tnr and is calculated as follows:

$$Tnr[^\circ\ C.]=174*\log\{\%\ Nb\ (\%\ C+12/14\%\ N)\}+1444 \quad (7)$$

wherein % Nb: respective Nb content,

% C: respective C content,

% N: respective N content;

e) Cooling of the finish hot rolled hot strip with a cooling speed of more than 15 K/s to a coiling temperature of 350-600° C.;

f) Coiling the hot strip cooled to the coiling temperature HT to form a coil and cooling the hot strip in the coil.

The thermomechanical hot rolling process carried out as work step d) prior to the cooling phase, in which the phase transformation occurs, is particularly significant for the according to the invention desired formation of a bainitic structure in the flat steel product produced according to the invention. The aim of the thermomechanical rolling here is to produce as many nucleation sites as possible as the starting point for the crystal reformation directly before the phase transformation. Recrystallisation of the austenite during rolling above the Ac3 temperature of the steel must be suppressed for this purpose.

In the first step, the cast structure of the slab should be broken up during hot rolling and transformed to a recrystallised austenite structure. Depending on the hot rolling system available, this first step can be carried out in the sense of conventional pre-rolling taking into account the conditions mentioned here. If necessary, the first rolling step can also have more than one hot rolling pass. It is important that, in the course of the first rolling step or the pre-rolling, the recrystallisation is still carried out fully and is not impaired.

The following rolling passes in the hot rolling finishing section are carried out such that the recrystallisation is continuously more strongly inhibited. This largely takes place due to precipitations of the added alloy elements, which exert a direct influence on the recrystallisation boundaries. Defined for this purpose are the RLT (Recrystallisation Limit Temperature) as the lowest temperature at which the static recrystallisation can still take place up to 95% or at which approx. 5% of the structure can no longer recrystallise and the RST (Recrystallisation Stop Temperature) as the highest temperature at which a static recrystallisation is suppressed to at least 95% at which i.e. 95% of the structure can no longer recrystallise. The RLT and the RST are, according to the definition, always above the Ac3 temperature of the steel, with the RST being the lowest temperature in order to start the pancaking process of the austenitic grains. The so-called non-recrystallisation temperature (Tnr), in technical jargon also called the "pancake temperature", is between the RLT and RST temperatures in the case of approx. 30% recrystallisation ability of the structure.

The temperature at which a complete static recrystallisation is largely suppressed and only a proportion of 30% can still recrystallise is designated with "Tnr". This is required to set a pancake structure. If this fractional softening can no longer take place by recrystallisation or recovery, the grains are simply strongly stretched during hot rolling.

In the case of only partial recrystallisation ability of the structure, most potential nucleation sites can develop. By forming at temperatures, which are lower than the RST, a very dislocation-rich austenite is produced as the basis for the transformation, but the surface of the stretched grains is proportionally small and only relatively few grain boundaries are available. By forming at a temperature as close as possible to the Tnr temperature, the stretched grains are, in contrast, partially moulded in and new grain boundaries formed, the so-called pancake structure results. Nevertheless, many dislocations remain such that the higher number of grain boundaries and a dislocation-rich austenite are available as nucleation sites for the forming.

The forming in the temperature condition of Tnr must be sufficiently great to achieve the desired effect. Therefore, the invention prescribes that the reduction ratio d0/d1 defined as the ratio of starting thickness d0 and end thickness d1 should be at least 1.5 for the Tnr. Optimised pancake structures are obtained when the reduction ratio d0/d1 is roughly 2 in the case of the Tnr temperature.

It also contributes to an optimised result of the thermomechanical rolling if the thickness reduction achieved over the total temperature range RLT-RST, in which the recrystallisation is prevented, gives a reduction ratio d0/d1 of more than 6.

In order to provide a sufficient temperature range for carrying out the thermomechanical rolling in the temperature range RLT-RST, it has been proven to be expedient if the difference WAT−WET between the hot rolling start temperature WAT and the hot rolling final temperature WET is more than 150° C., in particular at least 155° C.

The cooling rate of the cooling between the end of the hot rolling and the beginning of the coiling should be at least 15 K/s, in particular higher than 15 K/s, and preferably more than 25 K/s, in particular more than 40 K/s. With such high cooling speeds, it is also possible to carry out the cooling within the cooling path available there on conventional hot rolling lines such that the largely bainitic structure desired according to the invention is set in the hot rolled flat steel product. It is thus possible to achieve a complete bainitic transformation with the formation of a fine microstructure within an available intensive cooling time of typically ten seconds, taking into account the specifications according to the invention.

As already mentioned, Nb is one of the most effective elements for the recrystallisation delay due to its property, to be able to form fine precipitates in high temperature ranges. By adding Nb, it is therefore possible to influence the outlined temperature limits and in particular the position of the Tnr. At the same time. Nb also very effectively delays the phase transformation (so-called solute drag effect) due to the formation of precipitates. The carbon saturation of bainitic ferrite is 0.02-0.025%, which means that, when stoichiometrically considered, the carbon for the precipitate formation is in a virtually optimal ratio to the claimed alloy range of the carbide formers.

The coiling temperature HT is at least 350° C. Lower coiling temperature values would lead to an undesirably high proportion of martensite in the structure of the hot rolled flat steel product obtained. At the same time, the coiling temperature is limited to at most 600° C. because higher coiling temperatures would lead to the development of similarly undesired proportions of ferrite and perlite.

In the case of hot rolling final temperatures WET of less than 870° C., it has proven to be advantageous for the coiling temperature HT to be set to 350-460° C. This prevents the risk of the proportion of ferrite in the structure and therefore the proportion of the mixed structure of ferrite and bainite increasing too sharply. Such a mixed structure would negatively affect the hole expansion properties. A bainitic structure that is as uniform as possible is therefore desired.

In the case of hot rolling final temperatures WET of 870-950° C., the coiling temperature HT can, in contrast, be easily selected in the entire range predefined according to the invention, with coiling temperatures of 350-550° C. having been shown to be particularly effective here.

In order to protect a flat steel product produced according to the invention from corrosion or other weather influences, it can be provided with a Zn-based metallic protective coating applied by hot dip coating. To this end, it may, as already mentioned above, be expedient to set the Si content of the steel of which the flat steel product consists, in the manner already explained above.

The invention is explained in greater detail below using exemplary embodiments.

The steel melts A-M indicated in Table 1 have been melted, of which the melts D-G are alloyed according to the invention, whereas the melts A-C and H-M are not according to the invention.

Conventional slabs have been produced in each case in continuous casting from the steel melts A-M.

34 tests have been carried out with these slabs.

The slabs have been heated to a temperature range of 1000-1300° C. with a hot rolling start temperature WAT and then run into a hot rolling line.

In the hot rolling line, the hot strips rolled from the slabs passed through a thermomechanical rolling processing which they have been deformed over a temperature range RLT-RST with a total reduction ratio d0/d1ges, with a reduction ratio d0/d1 Tnr having been maintained in each case for the non-recrystallisation temperature Tnr.

The hot rolling was concluded at a hot rolling final temperature WET. The hot strips coming out of the hot rolling line at this temperature WET are cooled at a cooling rate t8/5 to the respective coiling temperature HT and then wound into a coil in which they were cooled to room temperature.

In Table 2 are indicated, for the tests 1-34, the respectively used steel A-M, the hot rolling start temperature WAT, the hot rolling final temperature WET, the non-recrystallisation temperature Tnr calculated according to the formula (7) for a 3 mm thick metal sheet, the Ac3 temperature of the respective steel, the bainite start temperature Bs, which has been calculated using the formula $$Bs=830-270\%\ C-37\%\ Ni-90\%\ Mn-70\%\ Cr-83\%\ Mo, \quad (8)$$

wherein % C respective C content,

% Ni=respective Ni content,

% Mn=respective Mn content,

% Cr=respective Cr content,

% Mo=respective Mo content of the steel, for a 3 mm thick metal sheet, the reduction ratio d0/d1ges, the reduction ratio d0/d1 Tnr, the cooling rate t8/5 and the coiling temperature HT.

The microstructures of the hot rolled steel strips obtained in the case of the tests 1-34 have been examined. The specified structural components of bainite "B", ferrite "F", martensite "M", cementite "Z" and retained austenite "RA" and the bainite hardness "HvB" calculated according to the formula (3), the ferrite hardness "HvF" calculated according to the formula (6), the martensite hardness "HvM" calculated according to the formula (5), the total hardness "Hv" calculated according to the formula (4), the value of the ratio "|(Hv−HvB)/Hv|" and the value of the ratio "|(HvB−HvF)/HvF|" are indicated in Table 3.

In Table 4 are indicated, for the hot rolled steel strips obtained in the tests 1-34, in each case in longitudinal and transverse direction of the respectively hot rolled steel strip the yield strength Rp0.2, the upper yield strength ReH, the lower yield strength ReL, the tensile strength Rm and the elongation A80, in each case determined according to DIN EN ISO 6892:2014. In addition, for each of the test results, the hole expansion LA determined based on the specifications of ISO 16630:2009 and according to the standard of the approach already outlined above is indicated.

The tests show that for example in the case of the steel F, the proportion of carbon bound by carbide and carbonitride formation is roughly 0.046%, whereby the carbon offering of 0.048% is virtually optimally exploited. Phases considered here are for example TiN, Nb(C, N), Cr3C2, $Mo_2C$ and TiC. An almost complete saturation of the bainitic ferrite with carbon and therefore a maximisation of the strength of the bainitic ferrite was thus achieved with simultaneously optimal other properties.

Evidently, the values indicated for the ratio "|(Hv−HvB)/Hv|" in Table 3 correlate well with the values indicated in Table 4 for the hole expansion LA, if the structure is largely bainitic in the manner according to the invention, the difference "|(Hv−HvB)/Hv|" is set to less than 5% and the required values for the mechanical properties Rp0.2, Rm and A80 are fulfilled.

Similarly, the examples show that in the case of suitably matching the difference |(HvB−HvF)/HvF| to values below 35%, good hole expansions LA are achieved.

The results of the tests 27 and 28 also show that by setting the N content to contents of 0.003-0.006 wt %, an improvement in the elongation can be achieved (for example in comparison to the results of the tests 22 and 23).

It is also notable that for the test results according to the invention, no marked upper and lower yield strengths could be determined.

TABLE 1

| Steel | C | Si | Mn | P | S | Al | Cu | Cr | Ni | Mo | V | Ti | Nb | B | N | According to the invention? |
|---|---|---|---|---|---|---|---|---|---|---|---|---|---|---|---|---|
| A | 0.049 | 0.26 | 0.98 | 0.002 | 0.004 | 0.027 | 0.012 | 0.03 | 0.02 | 0.099 | 0.001 | 0.013 | 0.02 | 0.0004 | 0.0012 | NO |
| B | 0.05 | 0.27 | 1.27 | 0.002 | 0.004 | 0.023 | 0.012 | 0.16 | 0.021 | 0.102 | 0.0005 | 0.015 | 0.042 | 0.0004 | 0.0023 | NO |
| C | 0.052 | 0.25 | 1.36 | 0.002 | 0.005 | 0.03 | 0.012 | 0.34 | 0.024 | 0.105 | 0.0005 | 0.11 | 0.043 | 0.0004 | 0.0021 | NO |
| D | 0.052 | 0.25 | 1.74 | 0.003 | 0.001 | 0.022 | 0.012 | 0.7 | 0.027 | 0.103 | 0.001 | 0.11 | 0.092 | 0.0004 | 0.0025 | YES |

TABLE 1-continued

| Steel | C | Si | Mn | P | S | Al | Cu | Cr | Ni | Mo | V | Ti | Nb | B | N | According to the invention? |
|---|---|---|---|---|---|---|---|---|---|---|---|---|---|---|---|---|
| E | 0.05 | 0.26 | 1.77 | 0.003 | 0.001 | 0.023 | 0.011 | 0.71 | 0.026 | 0.1 | 0.001 | 0.16 | 0.09 | 0.0004 | 0.0024 | YES |
| F | 0.048 | 0.27 | 1.83 | 0.004 | 0.001 | 0.039 | 0.06 | 0.69 | 0.1 | 0.11 | 0.006 | 0.12 | 0.05 | 0.0002 | 0.0086 | YES |
| G | 0.051 | 0.25 | 1.79 | 0.011 | 0.001 | 0.038 | 0.016 | 0.71 | 0.031 | 0.109 | 0.006 | 0.12 | 0.055 | 0.0002 | 0.0048 | YES |
| H | 0.035 | 0.09 | 1.45 | 0.011 | 0.0018 | 0.037 | 0.019 | 0.05 | 0.032 | 0.199 | 0.006 | 0.08 | 0.02 | 0.0005 | 0.0049 | NO |
| I | 0.075 | 0.6 | 1.77 | 0.012 | 0.001 | 0.037 | 0.034 | 0.33 | 0.045 | 0.015 | 0.007 | 0.12 | 0.001 | 0.0003 | 0.0046 | NO |
| J | 0.141 | 0.7 | 1.98 | 0.012 | 0.001 | 0.034 | 0.03 | 0.33 | 0.04 | 0.03 | 0.007 | 0.11 | 0.003 | 0.0004 | 0.0041 | NO |
| K | 0.084 | 0.49 | 1.86 | 0.013 | 0.001 | 0.06 | 0.035 | 0.04 | 0.053 | 0.14 | 0.006 | 0.11 | 0.045 | 0.0004 | 0.0039 | NO |
| L | 0.069 | 0.22 | 1.66 | 0.015 | 0.002 | 0.018 | 0.03 | 0.37 | 0.046 | 0.29 | 0.14 | 0.001 | 0.002 | 0.0003 | 0.0056 | NO |
| M | 0.062 | 0.06 | 1.65 | 0.014 | 0.003 | 0.032 | 0.012 | 0.03 | 0.034 | 0.003 | 0.01 | 0.12 | 0.062 | 0.0003 | 0.0056 | NO |

Information in % by weight, remainder Fe and unavoidable impurities
Contents not according to the invention are underlined

TABLE 2

| Test | Steel | WAT [° C.] | WET [° C.] | Ac3 [° C.] | Bs [° C.] | Tnr [° C.] | d0/d1ges | d0/d1Tnr | t8/5 [K/s] | HT [° C.] |
|---|---|---|---|---|---|---|---|---|---|---|
| 1 | A | 1115 | 870 | 895 | 718 | 922 | 2.0 | 2.0 | 42 | 420 |
| 2 | A | 1100 | 870 | 895 | 718 | 922 | 2.0 | 2.0 | 39 | 440 |
| 3 | B | 1100 | 870 | 880 | 682 | 981 | 3.1 | 1.5 | 44 | 420 |
| 4 | B | 1100 | 870 | 880 | 682 | 981 | 3.1 | 1.5 | 31 | 440 |
| 5 | C | 1090 | 830 | 890 | 660 | 985 | 3.1 | 2.0 | 35 | 440 |
| 6 | C | 1085 | 880 | 890 | 660 | 985 | 4.0 | 1.5 | 46 | 440 |
| 7 | D | 1080 | 830 | 880 | 601 | 1043 | 4.0 | 1.5 | 29 | 470 |
| 8 | D | 1065 | 835 | 880 | 601 | 1043 | 4.0 | 1.5 | 25 | 500 |
| 9 | D | 1090 | 870 | 880 | 601 | 1043 | 4.0 | 1.5 | 41 | 440 |
| 10 | D | 1100 | 870 | 880 | 601 | 1043 | 4.0 | 1.5 | 40 | 420 |
| 11 | E | 1070 | 870 | 890 | 598 | 1039 | 6.7 | 1.5 | 34 | 440 |
| 12 | E | 1025 | 870 | 890 | 598 | 1039 | 4.0 | 2.0 | 30 | 460 |
| 13 | F | 1100 | 900 | 890 | 591 | 999 | 1.9 | 1.3 | 33 | 480 |
| 14 | F | 1100 | 900 | 890 | 591 | 999 | 1.9 | 1.3 | 33 | 460 |
| 15 | F | 1100 | 900 | 890 | 591 | 999 | 1.9 | 1.3 | 34 | 440 |
| 16 | F | 1100 | 900 | 890 | 591 | 999 | 1.9 | 1.3 | 36 | 420 |
| 17 | F | 1085 | 830 | 890 | 591 | 999 | 4.4 | 1.5 | 33 | 500 |
| 18 | F | 1090 | 830 | 890 | 591 | 999 | 4.4 | 1.5 | 35 | 470 |
| 19 | F | 1095 | 830 | 890 | 591 | 999 | 4.4 | 1.5 | 32 | 440 |
| 20 | F | 1090 | 830 | 890 | 591 | 999 | 2.2 | 2.2 | 28 | 400 |
| 21 | F | 1090 | 830 | 890 | 591 | 999 | 2.2 | 2.2 | 26 | 420 |
| 22 | F | 1090 | 830 | 890 | 591 | 999 | 2.2 | 2.2 | 25 | 440 |
| 23 | F | 1100 | 900 | 890 | 591 | 999 | 2.8 | 1.6 | 47 | 420 |
| 24 | F | 1090 | 900 | 890 | 591 | 999 | 2.8 | 1.6 | 44 | 440 |
| 25 | F | 1095 | 900 | 890 | 591 | 999 | 2.8 | 1.6 | 42 | 460 |
| 26 | F | 1100 | 900 | 890 | 591 | 999 | 2.8 | 1.6 | 64 | 440 |
| 27 | G | 1100 | 870 | 890 | 595 | 1006 | 2.8 | 1.6 | 45 | 440 |
| 28 | G | 1090 | 870 | 890 | 595 | 1006 | 2.8 | 1.6 | 44 | 420 |
| 29 | H | 1100 | 900 | 890 | 669 | 914 | 2.8 | 1.6 | 45 | 440 |
| 30 | I | 1095 | 900 | 890 | 626 | 849 | 2.8 | 1.6 | 46 | 440 |
| 31 | J | 1100 | 900 | 870 | 587 | 857 | 2.8 | 1.6 | 44 | 440 |
| 32 | K | 1110 | 900 | 885 | 626 | 1023 | 2.8 | 1.6 | 45 | 440 |
| 33 | L | 1095 | 900 | 875 | 612 | 773 | 2.8 | 1.6 | 47 | 440 |
| 34 | M | 1100 | 900 | 890 | 662 | 1025 | 2.8 | 1.6 | 45 | 440 |

values not leading to results according to the invention are underlined

TABLE 3

| Test | Steel | B | F | M | Z | RA | HvB | HvF | HvM | Hv | \|(Hv − HvB)/Hv\| | \|(HvB − HvF)/HvF\| |
|---|---|---|---|---|---|---|---|---|---|---|---|---|
| | | [area %] | | | | [vol %] | | | | | [%] | [%] |
| 1 | A | 25 | 65 | 0 | 10 | <1 | 139 | 118 | | 126 | 10.32 | 15.11 |
| 2 | A | 20 | 70 | 0 | 10 | <1 | 136 | 118 | | 123 | 10.57 | 13.24 |
| 3 | B | 45 | 50 | 0 | 5 | <1 | 173 | 132 | | 153 | 13.07 | 23.70 |
| 4 | B | 40 | 55 | 0 | 5 | <1 | 158 | 130 | | 143 | 10.49 | 17.72 |
| 5 | C | 75 | 20 | 0 | 5 | <1 | 181 | 141 | | 173 | 4.62 | 22.10 |
| 6 | C | 86 | 10 | 0 | 5 | <1 | 192 | 143 | | 187 | 2.67 | 25.52 |
| 7 | D | 78 | 15 | 0 | 5 | <1 | 232 | 163 | | 221 | 4.98 | 29.74 |
| 8 | D | 75 | 20 | 0 | 5 | <1 | 229 | 161 | | 215 | 6.51 | 29.69 |
| 9 | D | 88.5 | 5 | 5 | 0 | 1.5 | 239 | 166 | 292 | 235 | 1.70 | 30.54 |

TABLE 3-continued

| Test | Steel | B | F [area %] | M | Z | RA [vol %] | HvB | HvF | HvM | Hv | \|(Hv − HvB)/Hv\| [%] | \|(HvB − HvF)/HvF\| [%] |
|---|---|---|---|---|---|---|---|---|---|---|---|---|
| 10 | D | 89 | 5 | 5 | 0 | 1 | 239 | 166 | 291 | 236 | 1.27 | 30.54 |
| 11 | E | 89 | 5 | 5 | 0 | 1 | 239 | 165 | 287 | 235 | 1.70 | 30.96 |
| 12 | E | 89 | 5 | 5 | 0 | 1 | 236 | 164 | 284 | 233 | 1.29 | 30.51 |
| 13 | F | 90 | 10 | 0 | 0 | <1 | 245 | 165 | | 237 | 3.38 | 32.65 |
| 14 | F | 90 | 10 | 0 | 0 | <1 | 245 | 165 | | 237 | 3.38 | 32.65 |
| 15 | F | 94 | 5 | 5 | 0 | 1 | 245 | 165 | 286 | 253 | 3.16 | 32.65 |
| 16 | F | 89.5 | 5 | 5 | 0 | 1.5 | 246 | 166 | 287 | 243 | 1.23 | 32.52 |
| 17 | F | 75 | 20 | 0 | 5 | <1 | 245 | 165 | | 229 | 6.99 | 32.65 |
| 18 | F | 80 | 15 | 0 | 5 | <1 | 246 | 166 | | 234 | 5.13 | 32.52 |
| 19 | F | 93.5 | 0 | 5 | 0 | 1.5 | 244 | | 285 | 243 | 0.41 | |
| 20 | F | 87.5 | 0 | 10 | 0 | 2.5 | 242 | | 282 | 240 | 0.83 | |
| 21 | F | 93 | 0 | 5 | 0 | 2 | 240 | | 280 | 238 | 0.84 | |
| 22 | F | 94 | 0 | 5 | 0 | 1 | 240 | | 279 | 239 | 0.42 | |
| 23 | F | 100 | 0 | 0 | 0 | <1 | 251 | | | 251 | | |
| 24 | F | 100 | 0 | 0 | 0 | <1 | 250 | | | 250 | | |
| 25 | F | 95 | 5 | 0 | 0 | <1 | 249 | 168 | | 245 | 1.63 | 32.53 |
| 26 | F | 100 | 0 | 0 | 0 | <1 | 257 | | | 257 | | |
| 27 | G | 95 | 5 | 0 | 0 | <1 | 246 | 167 | | 242 | 1.65 | 32.11 |
| 28 | G | 94 | 5 | 0 | 0 | 1 | 245 | 167 | | 239 | 2.51 | 31.84 |
| 29 | H | 70 | 25 | 0 | 5 | <1 | 158 | 133 | | 152 | 3.95 | 15.82 |
| 30 | I | 72 | 10 | 15 | 0 | 3 | 265 | 149 | 320 | 248 | 6.85 | 43.77 |
| 31 | J | 65 | 5 | 20 | 0 | 5 | 317 | 168 | 387 | 295 | 7.46 | 47.00 |
| 32 | K | 80 | 15 | 0 | 5 | <1 | 249 | 148 | | 234 | 6.41 | 40.56 |
| 33 | L | 80 | 5 | 15 | 0 | <1 | 230 | 92 | 304 | 235 | 2.13 | 60.00 |
| 34 | M | 59 | 30 | 0 | 10 | <1 | 164 | 139 | | 155 | 5.81 | 15.24 |

values not according to the invention are underlined

TABLE 4

| | | Longitudinal values | | | | | Transverse values | | | | | |
|---|---|---|---|---|---|---|---|---|---|---|---|---|
| Test | Steel | Rp0.2 | ReH [MPa] | ReL | Rm | A80 [%] | Rp0.2 | ReH [MPa] | ReL | Rm | A80 [%] | LA [%] |
| 1 | A | | 489 | 466 | 530 | 16 | | 487 | 463 | 535 | 15 | 134 |
| 2 | A | | 475 | 459 | 525 | 17 | | 474 | 459 | 532 | 15 | 131 |
| 3 | B | | 552 | 533 | 603 | 16 | | 565 | 546 | 604 | 14 | 94 |
| 4 | B | | 545 | 527 | 599 | 17 | | 558 | 542 | 601 | 16 | 91 |
| 5 | C | | 702 | 659 | 749 | 11 | | 706 | 687 | 755 | 9 | 63 |
| 6 | C | 626 | | | 697 | 10 | 637 | | | 757 | 10 | 72 |
| 7 | D | | 719 | 668 | 771 | 10 | | 722 | 664 | 773 | 9 | 60 |
| 8 | D | | 706 | 659 | 765 | 12 | | 710 | 674 | 773 | 10 | 58 |
| 9 | D | 728 | | | 854 | 11 | 776 | | | 863 | 10 | 76 |
| 10 | D | 736 | | | 866 | 10 | 784 | | | 868 | 10 | 82 |
| 11 | E | 782 | | | 861 | 11 | 756 | | | 863 | 10 | 83 |
| 12 | E | 776 | | | 856 | 12 | 749 | | | 856 | 11 | 79 |
| 13 | F | 677 | | | 849 | 14 | 714 | | | 846 | 12 | 70 |
| 14 | F | 696 | | | 853 | 13 | 777 | | | 877 | 11 | 71 |
| 15 | F | 702 | | | 850 | 12 | 784 | | | 867 | 11 | 75 |
| 16 | F | 716 | | | 842 | 12 | 819 | | | 868 | 11 | 78 |
| 17 | F | | 774 | 752 | 883 | 12 | | 846 | 828 | 928 | 11 | 56 |
| 18 | F | | 762 | 738 | 854 | 11 | | 822 | 807 | 888 | 9 | 59 |
| 19 | F | 698 | | | 845 | 14 | 796 | | | 865 | 13 | 75 |
| 20 | F | 751 | | | 876 | 12 | 841 | | | 882 | 10 | 71 |
| 21 | F | 748 | | | 873 | 12 | 820 | | | 871 | 10 | 72 |
| 22 | F | 727 | | | 854 | 12 | 806 | | | 875 | 11 | 78 |
| 23 | F | 732 | | | 843 | 12 | 837 | | | 867 | 10 | 81 |
| 23 | F | 722 | | | 855 | 12 | 806 | | | 865 | 11 | 83 |
| 25 | F | 706 | | | 845 | 13 | 826 | | | 875 | 12 | 75 |
| 26 | F | 736 | | | 864 | 12 | 755 | | | 871 | 12 | 81 |
| 27 | G | 707 | | | 840 | 15 | 814 | | | 855 | 13 | 79 |
| 28 | G | 700 | | | 847 | 14 | 822 | | | 860 | 13 | 77 |
| 29 | H | | 825 | 790 | 820 | 13 | | 888 | 825 | 856 | 11 | 64 |
| 30 | I | 705 | | | 825 | 14 | 737 | | | 844 | 13 | 45 |
| 31 | J | 759 | | | 1073 | 10 | 815 | | | 1085 | 7 | 11 |
| 32 | K | | 782 | 780 | 833 | 15 | | 804 | 803 | 854 | 13 | 54 |
| 33 | L | 707 | | | 881 | 14 | 755 | | | 882 | 11 | 57 |
| 34 | M | | 791 | 784 | 850 | 18 | | 851 | 830 | 877 | 17 | 49 |

values not according to the invention are underlined

The invention claimed is:

1. A hot rolled flat steel product made from a complex-phase steel, wherein the flat steel product has a hole expansion of at least 60%, a yield strength Rp0.2 of at least 660 MPa, a tensile strength Rm of at least 760 MPa and an elongation at break A80 of at least 10%, wherein the complex-phase steel comprises (in wt %):

C: 0.01-0.1%,
Si: 0.1-0.45%,
Mn: 1-2.5%,
Al: 0.005-0.05%,
Cr: 0.5-1%,
Mo: 0.05-0.15%,
Nb: 0.05-0.1%,
Ti: 0.05-0.2%,
N: 0.001-0.009%,
P: less than 0.02%,
S: less than 0.005%,
Cu: up to 0.1%
Mg: up to 0.0005%,
O: up to 0.01%, optionally one element or a plurality of elements from the group consisting of Ni, B, V, Ca, Zr, Ta, W, REM, Co, wherein:

Ni: up to 1%,
B: up to 0.005%,
V: up to 0.3%,
Ca: 0.0005-0.005%,
Zr, Ta, W: in total up to 2%,
REM: 0.0005-0.05%, and
Co: up to 1%, and iron and manufacture-related unavoidable impurities as the remainder, wherein the contents of the complex-phase steel of Ti, Nb, N, C and S meet the following conditions:

% Ti>(48/14) % N+(48/32) % S, and
% Nb<(93/12) % C+(45/14) % N+(45/32) % S wherein:

% Ti: respective Ti content,
% Nb: respective Nb content,
% N: respective N content,
% C: respective C content,
% S: respective S content, wherein % S can also be "0", and wherein the microstructure of the flat steel product comprises at least 80 area % bainite, of less than 15 area % ferrite, of less than 15 area % martensite, of less than 5 area % cementite and of less than 5 vol % retained austenite.

2. The flat steel product according to claim 1, wherein % Ti/% N>3.42 applies for the ratio % Ti/% N formed by the Ti content % Ti and the N content % N.

3. The flat steel product according to claim 1, wherein the theoretical hardness HvB of the bainite contained in the microstructure of the flat steel product is calculated according to the formula:

$$HvB=-323+185\%\ C+330\%\ Si+153\%\ Mn+65\%\ Ni+144\%\ Cr+191\%\ Mo+(89+53\%\ C-55\%\ Si-22\%\ Mn-10\%\ Ni-20\%\ Cr-33\%\ Mo)*\ln dT/dt,$$

wherein the theoretical total hardness Hv of the flat steel product is calculated according to the formula:

$$Hv=XM*HvM+XB*HvB+XF*HvF,$$

wherein the following applies:

$$|(Hv-HvB)/Hv|\leq 5\%,$$

wherein:

$$HvM=127+949\%\ C+27\%\ Si+11\%\ Mn+8\%\ Ni+16\%\ Cr+21*\ln dT/dt,$$

and $$HvF=42+223\%\ C+53\%\ Si+30\%\ Mn+12.6\%\ Ni+7\%\ Cr+19\%\ Mo+(10-19\%\ Si+4\%\ Ni+8\%\ Cr-130\%\ V)*\ln dT/dt,$$

and wherein:

% C: respective C content of the complex-phase steel;
% Si: respective Si content of the complex-phase steel;
% Mn: respective Mn content of the complex-phase steel;
% Ni: respective Ni content of the complex-phase steel;
% Cr: respective Cr content of the complex-phase steel;
% Mo: respective Mo content of the complex-phase steel;
% V: respective V content of the complex-phase steel;
ln dT/dt: natural logarithm of the t 8/5 cooling rate in K/s;
XM: proportion of martensite of the microstructure of the flat steel product in area %;
XB: proportion of bainite of the microstructure of the flat steel product in area %; and
XF: proportion of ferrite of the microstructure of the flat steel product in area %.

4. The flat steel product according to claim 1, wherein when ferrite is present in the microstructure of the flat steel product the theoretical hardness HvB of the bainite contained in the microstructure of the flat steel product is calculated according to the formula:

$$HvB=-323+185\%\ C+330\%\ Si+153\%\ Mn+65\%\ Ni+144\%\ Cr+191\%\ Mo+(89+53\%\ C-55\%\ Si-22\%\ Mn-10\%\ Ni-20\%\ Cr-33\%\ Mo)*\ln dT/dt,$$

and the theoretical hardness HvF of the ferrite contained in the microstructure of the flat steel product is calculated according to the formula:

$$HvF=42+223\%\ C+53\%\ Si+30\%\ Mn+12.6\%\ Ni+7\%\ Cr+19\%\ Mo+(10-19\%\ Si+4\%\ Ni+8\%\ Cr-130\%\ V)*\ln dT/dt,$$

wherein the following applies:

$$|(HvB-HvF)/HvF|\leq 35\%,$$

and wherein:

% C: respective C content of the complex-phase steel;
% Si: respective Si content of the complex-phase steel;
% Mn: respective Mn content of the complex-phase steel;
% Ni: respective Ni content of the complex-phase steel;
% Cr: respective Cr content of the complex-phase steel;
% Mo: respective Mo content of the complex-phase steel;
% V: respective V content of the complex-phase steel; and
ln dT/dt: t 8/5 cooling rate in K/s.

5. The flat steel product according to claim 1, wherein the C content is at least 0.04 wt % and not more than 0.06 wt %.

6. The flat steel product according to claim 1, wherein the Cr content is at least 0.6 wt % and not more than 0.8 wt %.

7. The flat steel product according to claim 1, wherein the Nb content is not more than 0.06 wt %.

8. The flat steel product according to claim 1, wherein the Ti content is at least 0.1 wt % and not more than 0.13 wt %.

9. The flat steel product according to claim 1, wherein a Zn-based metallic protective coating is applied to the flat steel product by hot dip coating.

10. A method for manufacturing the hot rolled flat steel product according to claim 1, comprising the steps of:

a) melting the steel b) casting the melted steel to form an intermediate product;

c) heating the intermediate product to a pre-heating temperature of 1100-1300° C.;

d) hot rolling the intermediate product to form a hot rolled strip, wherein a rolling start temperature WAT of the intermediate product at the start of the hot rolling is 1000-1250° C. and a rolling final temperature WET of the finished hot rolled strip is 800-950° C. and wherein the hot rolling is carried out in a temperature range of a recrystallisation limit temperature RLT-a recrystallisation stop temperature RST with a reduction ratio d0/d1 of at least 1.5, wherein a starting thickness d0 of the hot rolled strip prior to the beginning of the rolling in the temperature range RLT-RST is designated with d0 and a thickness of the hot rolled strip after rolling in the temperature range RLT-RST is designated with d1 and wherein:

in the event that the reduction ratio d0/d1 is ≤2, the temperature is RLT=Tnr+50° C., in the event that the reduction ratio d0/d1 is >2, the temperature is RLT=Tnr+100° C., in the event that the reduction ratio d0/d1 is ≥2, the temperature is RST=Tnr−50° C., in the event that the reduction ratio d0/d1 is <2, the temperature is RST=Tnr−100° C., and the non-recrystallisation temperature is designated with Tnr and is calculated as follows:

$$Tnr[°\ C.]=174*\log\{\%\ Nb*(\%\ C+12/14\%\ N)\}+1444,$$

wherein:

% Nb: respective Nb content,

% C: respective C content, and

% N: respective N content;

e) cooling of the hot rolled strip with a cooling rate of more than 15 K/s to a coiling temperature HT of 350-600° C.; and f) coiling the hot rolled strip cooled to the coiling temperature HT to form a coil and cooling the coil.

11. The method according to claim 10, wherein in step d), the reduction ratio d0/d1 when hot rolling in the temperature range RLT-RST is at least 2.

12. The method according to claim 10, wherein the reduction ratio d0/d1 achieved in step d) by hot rolling in the temperature range RLT-RST is at least 6.

13. The method according to claim 10, wherein in step e), the cooling rate is more than 25 K/s.

14. The method according to claim 10, wherein when the hot rolling final temperature WET is less than 870° C., the coiling temperature HT is 350-460° C.

15. The method according to claim 10, wherein when the hot rolling final temperature WET is at least 870° C., the coiling temperature HT is 350-550° C.

* * * * *